United States Patent [19]

Maynard, Jr.

[11] 4,426,027

[45] Jan. 17, 1984

[54] POURING SPOUT FOR LIQUID CONTAINERS

[76] Inventor: Walter P. Maynard, Jr., Suite 236, 3070 Presidential Dr., Atlanta, Ga. 30340

[21] Appl. No.: 345,786

[22] Filed: Feb. 4, 1982

[51] Int. Cl.[3] ..... B65D 25/50

[52] U.S. Cl. ..... 222/529; 222/530; 222/539

[58] Field of Search ..... 222/527, 530, 526, 539, 222/538, 529, 568; 141/338, 343

[56] References Cited

U.S. PATENT DOCUMENTS 2,534,434 12/1950 Gersten ..... 222/539

2,757,829 8/1956 Ahlquist ..... 222/527

4,241,856 12/1980 Otterson ..... 222/539

*Primary Examiner*—Joseph J. Rolla

*Assistant Examiner*—Frederick R. Handren

*Attorney, Agent, or Firm*—William H. Needle

[57] ABSTRACT

A simpler, more efficient and convenient, flexible pouring spout for liquid containers has the ability to reach fill-points without employing a funnel. The spout, when inverted, stores easily within the container and is effectively sealed with the container neck in both the pouring and stored positions. A single threaded cover cap can engage threads on either end of the pouring spout to prevent leakage.

1 Claim, 2 Drawing Figures

POURING SPOUT FOR LIQUID CONTAINERS

BACKGROUND OF THE INVENTION

The invention seeks to satisfy an increasing demand for a better pouring spout assembly for liquid containers, such as gasoline cans. Many prior art spouts tend to be slow pouring and have poor seals resulting in leakage and evaporation. The spouts are not sufficiently durable and can even be dangerous when they allow the escape of gasoline fumes. Some known spouts are too complex and costly to appeal widely to the public.

The present invention eliminates these drawbacks by providing a pouring spout which is extremely simple, durable, safe and has the ability to reach difficult fill-points on automobiles, motorcycles, lawnmowers and the like. It is very economical to manufacture.

Other features and advantages of the invention will become apparent during the course of the following detailed description.

DETAILED DESCRIPTION

Figures 1, 2:
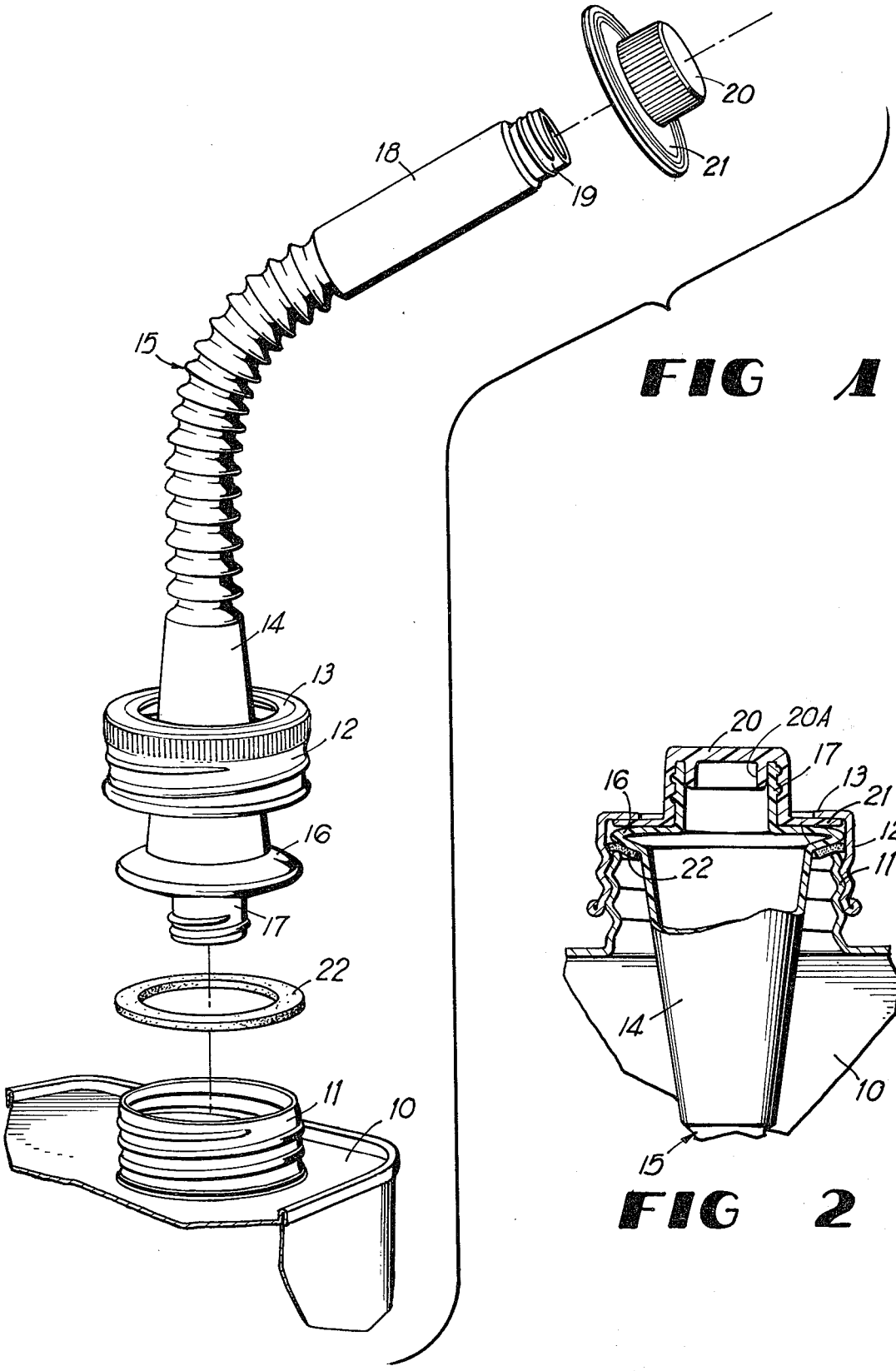
FIG. 1 is an exploded perspective view of a pouring spout in accordance with the invention.
FIG. 2 is a fragmentary vertical section showing the spout in a stored position on a container.

Referring to the drawings wherein like numerals designate like parts, a liquid container 10, such as a metal can, has a top threaded neck 11 serving as the outlet for the liquid in the can. A threaded adapter and sealing ring 12 engageable with the neck 11 includes an annular end wall 13. A coacting conically tapered adapter body portion 14 on one end of a flexible tubular pouring spout 15 carries at its larger end a generally V-cross section enlarged ring 16 whose outside diameter is approximately equal to that of the neck 11. Beyond this ring, a reduced diameter cylindrical threaded neck 17 leads from the ring 16 and is considerably smaller than the bore of the container neck 11.

A convenience hand grip 18 is provided on the far end of the spout 15 and a leading end threaded outlet neck 19 of the same diameter as the neck 17 is also provided on the spout.

A dual purpose threaded closure cap 20 having a wide radial flange 21 approximately equal to the diameter of the ring 16 is engageable with either of the threaded necks 17 and 19. As seen in FIG. 2, the cap 20 includes a co-axial inner sealing surface in the form of a tapered plug 20A. An annular compressible sealing gasket 22 is provided for sealing engagement with the mouth of the container neck 11 when the pouring spout 15 is in the pouring position of FIG. 1 or the inverted stored position within the container 10, as shown in FIG. 2. When the spout is in the pouring position, the lower side of ring 16 bears on the gasket 22 to compress it against the neck 11 while the wall 13 of threaded ring 12 bears on the top of ring 16 while threadedly engaging the container neck 11 to produce a leak-proof seal. The cap 20 can then be used on the neck 19 of the spout to effectively close the latter, with the exterior sealing surface of plug 20A bearing against neck 17.

To store the spout 15 in the container 10, the spout is inverted and placed through the neck 11 with the adapter body portion 14 uppermost. The ring 16 now has its other side bearing on the sealing gasket 22 and the size of the ring prevents it from entering the neck 11. The closure cap 20 engages the threaded neck 17 which is now uppermost with the plug 20A bearing against neck 17, and the ring 12 threadedly engages the neck 11 and has its top wall or flange 13 bearing on the wide flange 21 of cap 20 which, in turn, bears on the upper side of V-cross section ring 16, FIG. 2. A very effective liquid seal is thereby produced and no fumes can escape from the container when the spout is in the stored mode. The construction is highly compact, convenient, simplified and very economical and amounts to a distinct improvement over the known prior art.

It is to be understood that the form of the invention herewith shown and described is to be taken as a preferred example of the same, and that various changes in the shape, size and arrangement of parts may be restored to, without departing from the spirit of the invention or scope of the subjoined claims.

I claim:

1. A pouring spout for a container having a threaded neck comprising a tubular elongated spout body which is at least in part flexible and provided at opposite ends with threaded necks of equal thread size, a threaded closure cap having a wide marginal flange approximately equal to the diameter of the container neck and adapted for threaded engagement with either of said equal thread size necks, an adapter portion integrally formed on one end of the spout body and having an enlarged ring substantially larger in diameter than the equal thread size necks and approximately equal in diameter to the container neck, a container neck sealing gasket adapted for engagement between the end of the container neck at either side of the enlarged ring, and a threaded adapter and sealing ring of sufficient size to pass over the enlarged ring and said gasket and adapter to threadedly engage the container neck and including an annular end wall adapted to bear on the enlarged ring when the spout is in a pouring position and to bear on said wide flange of the closure cap when the spout is in an inverted stored position within the container, said enlarged ring of the adapter portion being roughly V-shaped in cross section and hollow, the adapter portion being conically tapered away from one side of the ring and toward the outlet end of the spout.

* * * * *